US006945671B1

(12) United States Patent
Swarens et al.

(10) Patent No.: US 6,945,671 B1
(45) Date of Patent: Sep. 20, 2005

(54) COMPACT FLUORESCENT LIGHTING UNIT WITH ADJUSTABLE BEAM SPREAD

(75) Inventors: Toni F. Swarens, 1830 Olivewood St., LaVerne, CA (US) 91750; Anatoly Kudishevich, Van Nuys, CA (US); Milton L. Hedberg Jr., Tustin, CA (US)

(73) Assignee: Toni F. Swarens, LaVerne, CA (US)

( * ) Notice: Subject to any disclaimer, the term of this patent is extended or adjusted under 35 U.S.C. 154(b) by 0 days.

(21) Appl. No.: 10/656,456

(22) Filed: Sep. 5, 2003

(51) Int. Cl.[7] ..... F21S 10/00

(52) U.S. Cl. ..... 362/233; 362/220; 362/225; 362/250; 362/270; 362/285; 362/346; 362/429; 362/371; 362/428

(58) Field of Search ..... 362/233, 217, 362/220, 225, 250, 270, 285, 296, 341, 346, 362/418, 429, 371, 427, 428

(56) References Cited

U.S. PATENT DOCUMENTS 3,118,619 A * 1/1964 Harling ..... 362/371
3,749,907 A * 7/1973 Allmand ..... 362/371
4,811,177 A * 3/1989 Lauckhardt et al. ..... 362/220

FOREIGN PATENT DOCUMENTS

DE 3437192 A1 * 4/1986 ..... F21V 13/10

* cited by examiner

*Primary Examiner*—Sandra O'Shea
*Assistant Examiner*—Sharon Payne
(74) *Attorney, Agent, or Firm*—J. E. McTaggart

(57) ABSTRACT

A compact portable fluorescent lighting unit provides concentrated even coverage illumination for many visual arts, theater, studio or location applications. Beam width is conveniently user-adjustable without tools, typically in three steps: 60, 70 and 90 degrees. A pair of identical lighting cells are stacked one above the other; each cell can utilize any one of a variety of fluorescent lamps providing powerful illumination. Each cell has an efficient reflector and provision for beam width selection by varying the spacing of the lamp from the rear of the reflector via easily adjustable socket/lamp support brackets. A welded aluminum mounting yoke, with arms swivel-attached to opposite ends of the housing, can be set to any desired orientation for beam-aiming and locked in place to the housing by a user knob. The yoke can be affixed directly to building structure or mounted via a pipe or stand adaptor, optionally swivelled to provide a second beam-aiming axis.

3 Claims, 4 Drawing Sheets

COMPACT FLUORESCENT LIGHTING UNIT WITH ADJUSTABLE BEAM SPREAD

FIELD OF THE INVENTION

The present invention relates to the field of electric lighting products, and more particularly it relates to structure of a compact lighting unit that enables convenient adjustment of the beam spread and direction for deployment as a portable utility studio light source for illuminating a designated area uniformly, e.g. in fields of endeavor such as architecture, photography, video, filming, theater, television and the like.

BACKGROUND OF THE INVENTION

In the field of visual arts such as the theater industry there are many requirements for compact portable light sources that are adjustable so they can be set up flexibly for the requirements of particular scenarios. Traditionally such adjustable light source have often utilized incandescent lighting as evidenced by the stereotype of actors and musicians sweating under the heat of powerful incandescent lamps. The inherent characteristic of the incandescent lamp in approximating a point source of light lends itself to optical processing especially for narrow beam spotlights, however an elongated tubular shape is more suited to "washing" designated areas uniformly and can be implemented with fluorescent lamps which offer the further advantage of being much more electric power efficient. Typically two or four tubular fluorescent lamps can produce results that would require an array made from a large quantity of individual incandescent lamps.

A key parameter in portable "wash" lighting units is the angle of beam spread between the half power illumination limits relative to the longitudinal central axis, since this determines the concentration and the coverage of a single unit and determines the spacing and quantity required when a plurality of such units are deployed for uniform illumination over a large area.

In compact fluorescent units of known art, the beam spread is a fixed parameter that is set in design by the shape of the reflector and the relative location of the fluorescent lamps. Thus, to accommodate a required range of beam spreads, a supplier or user must stock numerous versions of the unit in different models, each with a different beam spread rating, typically ranging from 60 to 90 degrees, or use additional accessories that attach to the front of the fixture to alter the beam.

DESCRIPTION OF KNOWN ART

Amongst numerous U.S. patents disclosing indirect lighting fixtures of various categories, U.S. Pat. Nos. 4,748,543, 5,142,459 and 5,988,836 by inventor Ralph W. Swarens are incorporated herein by reference for purposes of describing the background and general principles of lighting products, particularly fluorescent lighting products.

In fixtures of known art suitable for the field of endeavor addressed by the present invention, where the spacing between the lamp(s) and the reflector is fixed, a small range of beam spread is sometimes obtained through the use of a special diffusing panel, typically at some sacrifice of efficiency.

U.S. Pat. No. 5,510,965 to Teakell for an ADJUSTABLE REFLECTOR/DIRECTOR FOR FLUORESCENT LIGHT FIXTURE discloses the approach of surrounding the lamp with a close-fitting adjustable sleeve with a reflective and/or variable opacity surface formed to vary the direction and intensity of the light. The lamp is located in fixed relation relative to an enclosure box.

U.S. Pat. No. 6,450,668 to Kotloff for a MULTI-ANGLE LIGHTING FIXTURE discloses a luminaire-style lighting fixture having a central housing with a pair of lamp-supporting reflector panels pivotally secured to opposite sides of the housing. This arrangement would tend to produce two separate fields of illumination that are each independently adjustable for direction but not for spread, thus apart from a unique setting that aligns the two fields exactly side-by-side, all other settings would be characterized by non-uniformity in a central portion of the overall field of illumination, due to either an overlap that would over-illuminated a gap that would be under-illuminated.

U.S. Pat. No. 6,244,729 to Wldmann for a LAMP ASSEMBLY WITH ADJUSTABLE REFLECTOR discloses the approach of physically forcing changes of curvature in a flexible trough-like metal reflector.

U.S. Pat. No. 4,669,033 to Lee for an ADJUSTABLE OPTICAL REFLECTOR discloses the approach of introducing a reflector formed in a trough shape from adjacent panels of reflective cardboard between the fluorescent lamp and its rectangular housing.

U.S. Pat. No. 6,079,851 to Altman et al. discloses in its title a FLUORESCENT LIGHTING FIXTURE HAVING TWO SEPARATE END SUPPORTS, SEPARATE INTEGRAL BALLAST SUBASSEMBLY AND LAMPS SOCKETS, AND HOOD POSITIONABLE ABOVE END SUPPORTS FOR MOUNTING IN OR BELOW OPENING IN SUSPENDED CEILING.

U.S. Pat. No. 6,523,975 to Plourde et al. for an ADJUSTABLE SUPPORT AND METHOD OF MODIFYING A FLOURESCENT LIGHT FIXTURE discloses adjustable support adaptor members for installing a new reflector as an upgrade to an existing fixture box.

U.S. Pat. No. 5,207,504 to Swift et al. for a METHOD AND APPARATUS FOR TUNING STRIP FLOURESCENT LIGHT FIXTURES discloses a high intensity lighting system that can be retrofitted to an existing strip fixture and tuned for intensity and glare by various combinations of components including diffusion panels.

U.S. Pat. No. 6,092,913 to Edwards Jr. for a FLUORESCENT LIGHT FIXTURE discloses the approach providing lamps mounted on brackets that can be moved in a manner and direction that modifies the shape of a flexible reflector in response to varying the spacing of the brackets from each other.

Foregoing are examples of known art much of which is directed to typical four or eight foot ceiling lamp fixtures.

OBJECTS OF THE INVENTION

It is a primary object of the present invention to provide a compact fluorescent unit directed to providing concentrated even coverage for studio or location lighting applications with adjustable beam spread.

It is a further object to provide capability of changing the beam spread to one of three values: 60, 70 or 90 degrees by simple adjustment of the lamp position without requiring any tools.

It is a further object to provide a housing with an adjustable mounting yoke to facilitate mounting and aiming.

SUMMARY OF THE INVENTION

The above mentioned objects have been met by the present invention of a compact portable fluorescent lighting unit, well suited to meet requirements for concentrated even coverage illumination for a variety of visual arts, theater, studio or location applications. The unit provides convenient beam width adjustment by the user without tools, typically in three steps: 60, 70 and 90 degrees. A pair of identical lighting cells are stacked one above the other; each cell has a biaxial (folded tubular) fluorescent lamp rated at 55 watts: the 110 watts total provides powerful illumination. Each cell has an efficient reflector design and can utilize any one of a variety of biaxial (folded tube), quad (double folded tube) or triple (triple folded tube) fluorescent lamps providing powerful illumination. Each cell has provision for beam width selection by varying the spacing of the lamp from the rear of the reflector via easily adjustable socket/lamp support brackets. A welded aluminum yoke with arms swivel-attached to the ends of the housing allows vertical or horizontal mounting and enables the housing to be rotated in a first plane and locked in place by a user knob. External attachment to the yoke can provide rotation in a second plane, perpendicular to the first plane, and locking, via a standard ⅝" pipe or equivalent swivel/clamp fastening.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
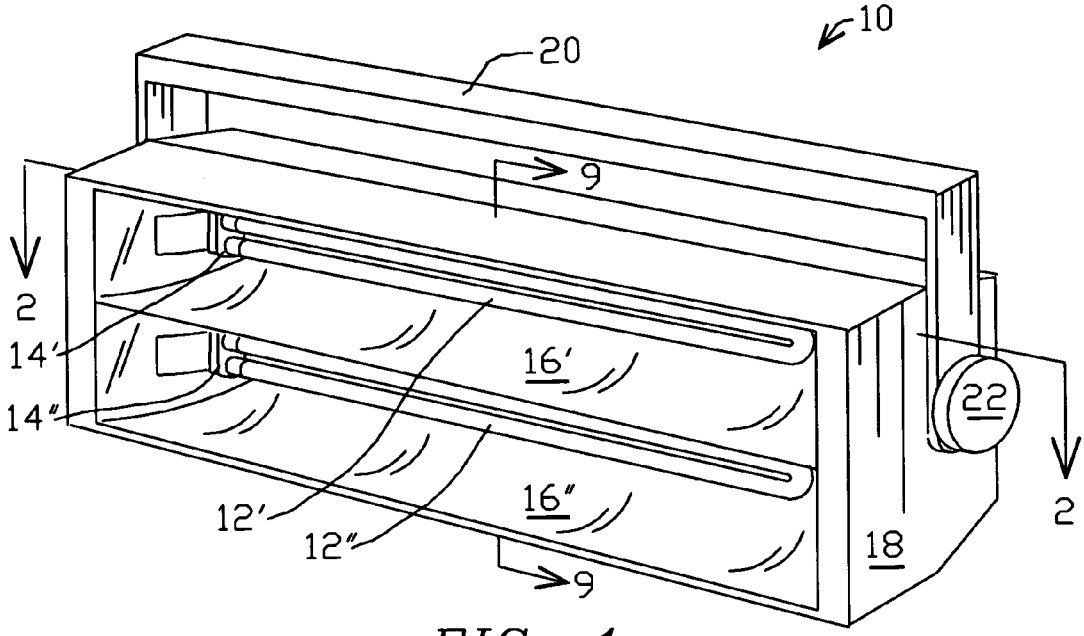
FIG. 1 is a perspective view of a compact portable fluorescent lighting unit of the present invention.

FIG. 1 is a perspective view of a compact portable fluorescent lighting unit 10 representing a preferred embodiment of the present invention in which two essentially identical lighting cells are stacked one above the other. Two U-shaped fluorescent lamps 12' and 12", associated sockets 14' and 14", and associated curved reflectors 16' and 16", are contained in an elongate metal housing 18, preferably formed from 0.063 aluminum and coated with black textured TGIC polyester powder coat finish.

Housing 18 is fitted with a welded aluminum mounting yoke 20 with two arms that are attached in a swivel manner to opposite ends of housing 18. Yoke 20 can be locked in any selected orientation on housing 18 by tightening the internally-threaded user knob 22 at the right hand end.

Yoke 20 can be bolted directly to building structure, pipe-mounted via a C-clamp or stand-mounted via a stand adaptor. If yoke 20 is swivel-mounted, housing 18 can be swivelled on two axes to aim the light beam from the front light-exit aperture in any desired angle.

Figure 2:
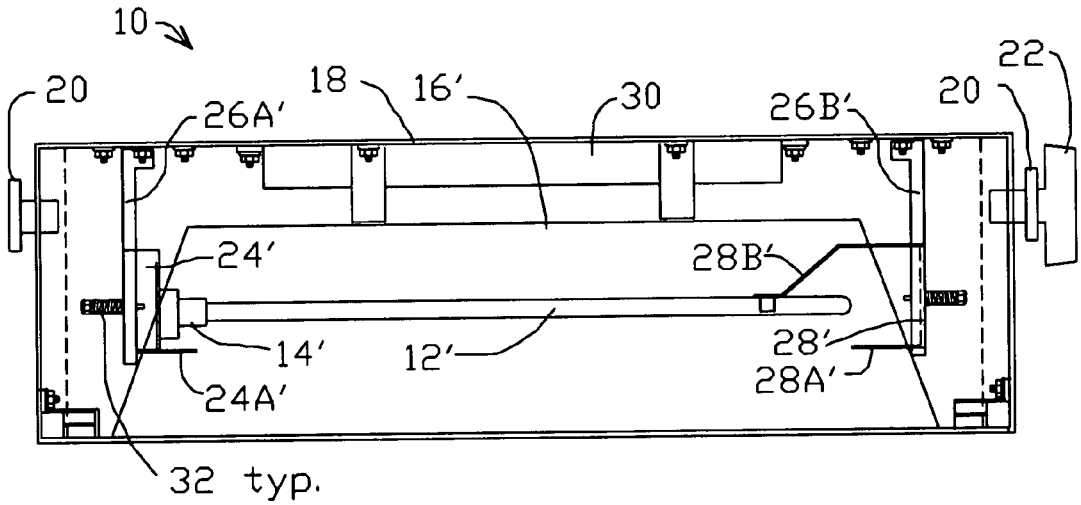
FIG. 2 is a cross-section taken from above the lighting unit of FIG. 1 through axis 2—2.

FIG. 2 is a cross-section showing the elements of the upper one of the two lighting cells of lighting unit 10 taken from above through axis 2—2 of FIG. 1. Fluorescent lamp 12' is supported by lamp socket 14' at the left hand end and by a lamp holder 28' at the right hand end.

At the left hand end, socket 14' is mounted to a metal socket-mount bracket 24' which is adjustably attached to metal socket-support base bracket 26A' via a spring-loaded fastening 32.

At the right hand end, lamp holder 28' is adjustably attached to base bracket 26B', which is similar to socket-support base bracket 26A'.

A pair of lever arms 24A' and 28A' are configured as part of socket-mount and socket-support brackets 24 and 28 respectively, to serve as user adjustment handles for setting the lamp 12' to one of three available spacings from the rear of the reflector 16' for different degrees of beam spread.

Base brackets 26A' and 26B' are bolted to the rear panel of housing 18, shown at the top of FIG. 2. Also bolted to the rear panel is a ballast unit 30 for lamp 12'.

Reflector 16', made from specular or semi-specular 0.020" high purity aluminum reflector material with 95% reflectance finish, surrounds tube 12' on three sides, forming a generally parabolic cross-sectional shape that opens to the light-exit aperture at the front of housing 18, located at the bottom of FIG. 2. A flared end reflective member is configured at each end of reflector 16' as shown.

The vertical end arms of yoke 20 appear one at the left hand end where yoke 20 is swivel-attached to housing 18 and the other at the right hand end where it is clamped in place to housing 18 by user knob 22.

Not visible in this view but located directly beneath is another identical lighting cell with its set of components, identical to those described above: lamp 12", socket 14", socket mount bracket 24", base brackets 26A" and 26B" and reflector 16". Typically reflectors 16' and 16" are made integrally as a one-piece dual reflector, and ballast 30 is implemented as a dual unit for both lamps 12' and 12", typically rated at 55 watts each, e.g. type FT55W/2G11/830.

Socket-support base bracket 26A extends through a clearance opening configured in the end panel of the reflector 16 and is bolted to the rear panel of the housing as indicated along the top of FIG. 2. Socket-mount bracket 24 is urged against base bracket 26A by a steel coil spring in each of a pair of spring-loaded fasteners 32.

It is seen in FIGS. 3–8 that the pair of spring-loaded fasteners 32 traverse a corresponding pair of slots 34 in each base bracket 26A/B, providing a range of adjustment in each lighting cell. A user, grasping handles 24A (FIGS. 2, 3–5) and 28A, (FIGS. 2, 6–8) can shift the socket-support bracket 24 (along with socket 14) and the lamp-support bracket 28 (along with lamp holder 28B, anywhere within the range provided by slots 34 and thus set the spacing between the lamp 12 and the rear of the reflector so as to adjust the beam spread.

Figure 3:
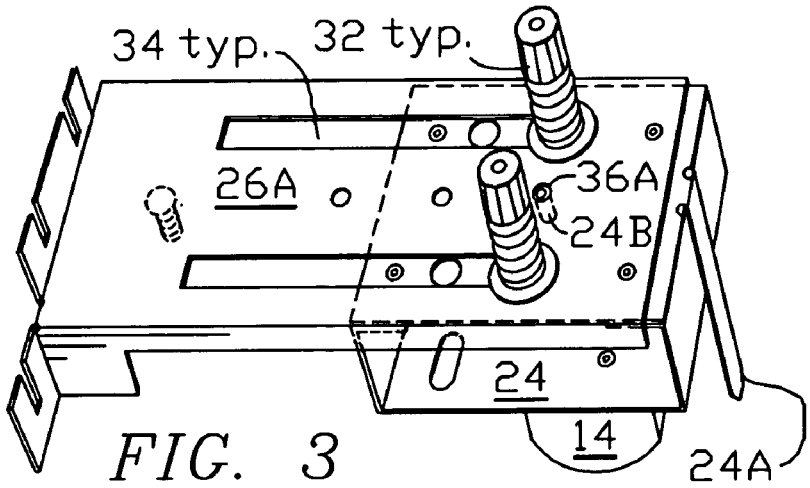
FIGS. 3–5 are perspective views of the socket support base bracket at the left hand end of the lighting unit of FIG. 2, showing the socket mount bracket set to the wide, medium and narrow beam spread preset locations respectively.
Figure 4:
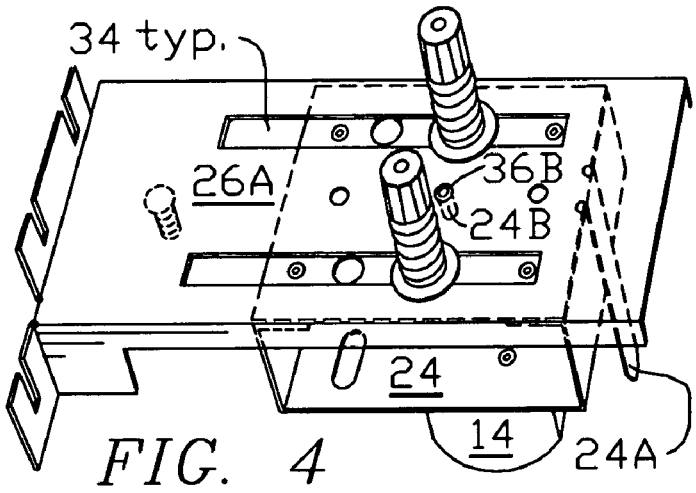
Figure 5:
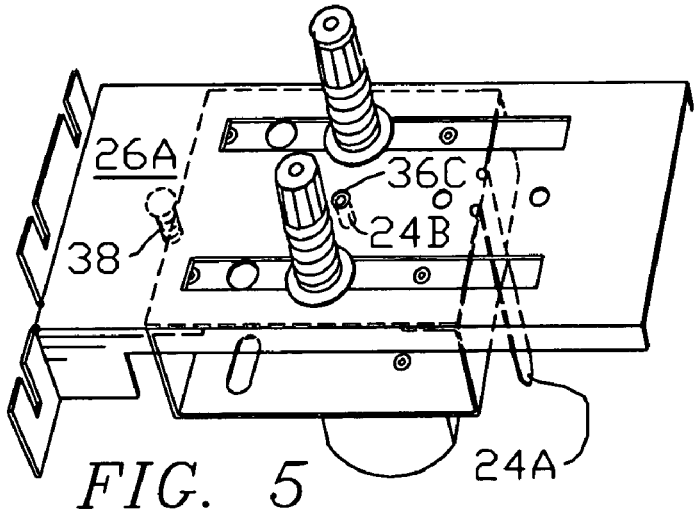

FIGS. 3–5 each show the perspective view of a typical socket-support base bracket 26A (refer to FIG. 2), as viewed from a low forward viewpoint located beyond the left hand end of the lighting unit 10 of FIG. 1, FIG. 3 shows socket-support base bracket 26A with socket-mount bracket 24 having been set to the forward end of the range i.e. the wide beam spread location toward the right as shown and thus furthest from the rear of the reflector. Bracket 24 is retained at this setting by the detent action of a spring-loaded set pin 24B, that is fastened to bracket 24, and that engages a locating hole 36A in base bracket 26A. This hole 36A is the furthest to the right, as shown, of three such locating holes, typically one inch apart, that can be selected by the user to select one of the three preset lamp locations, which is then held by the detent action of set pin 24B.

FIG. 4 shows the items of FIG. 3, but with the socket mount bracket 24 and lamp socket 14 having been reset to the medium beam spread preset location on base bracket 26A by shifting the socket-mount bracket 24 toward the rear of the reflector, i.e to the left as shown, until the spring-loaded set pin 24B engages the middle hole 36B in base bracket 26A.

FIG. 5 shows the items of FIGS. 3–4, but with the socket-mount bracket 24 and lamp socket 14 having been further reset to the narrow beam spread preset location, i.e. nearest to the rear of the reflector, with the spring-loaded set pin 24B engaging the rear locating hole 36C (furthest to the left as shown) in base bracket 26A. A stud 38 mounted in base bracket 26A serves as an end-stop to constrain socket-mount bracket 24 against any further travel.

Figure 6:
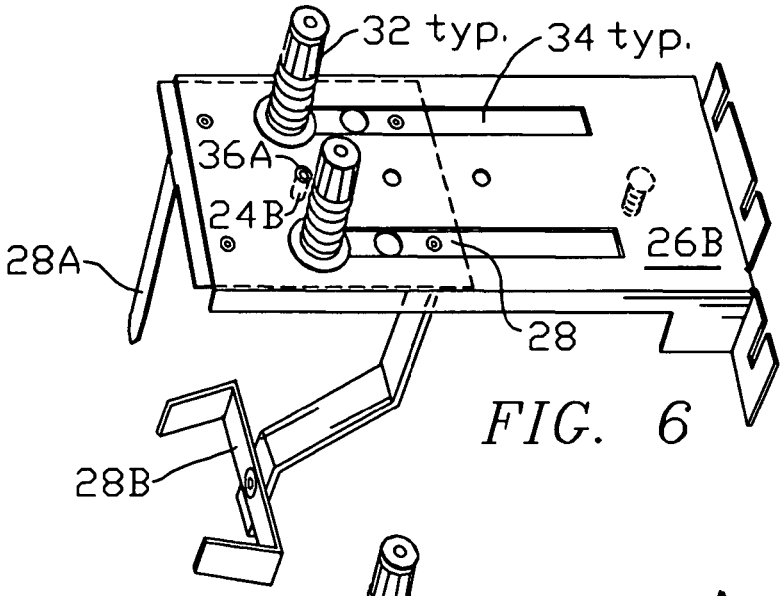
FIGS. 6–8 are perspective views of the lamp support base bracket at the right hand end of the lighting unit of FIG. 2, showing the the lamp holder set to the wide, medium and narrow beam spread preset locations respectively.
Figure 7:
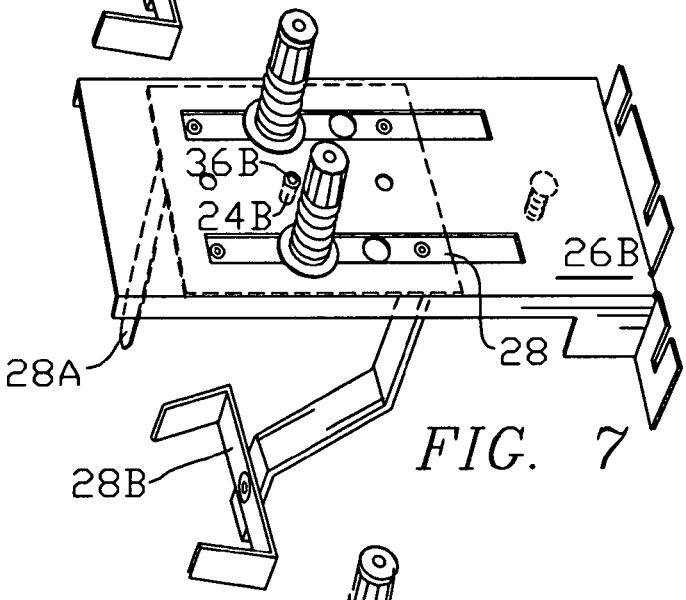
Figure 8:
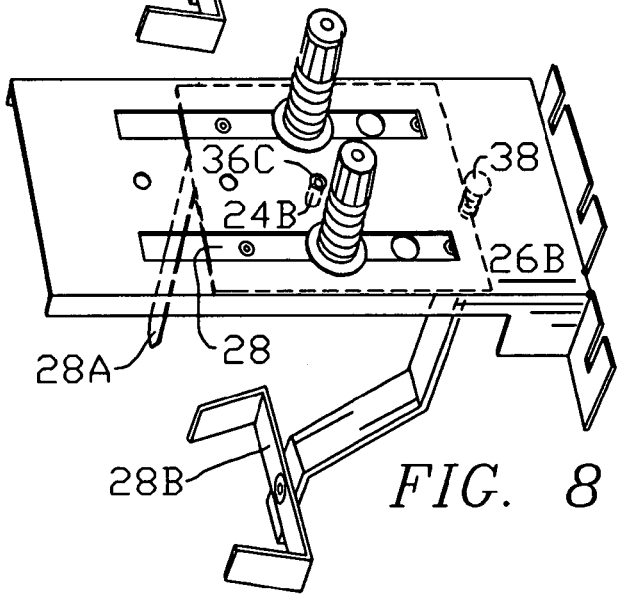

FIGS. 6–8 each show the perspective view of a typical lamp-support base bracket 26B (FIG. 2), taken from a low forward viewpoint located beyond the right hand end of the lighting unit 10 (FIG. 1), showing the lamp-holder bracket 28 set to the wide, medium and narrow preset beam spread locations respectively, corresponding to these three preset locations shown in FIGS. 3–5, which are implemented in the same manner by spring-loaded fasteners 32 and slots 34 configured in bracket 26B, and retained at the selected one of the three preset locations by detent action of a spring-loaded set pin 28B in tube-support bracket 24, engaging the appropriate locating hole 36A, 36B or 36C in base bracket 26B.

FIG. 6 shows lamp-support base bracket 26B with lamp-support bracket 28 having been set to the wide beam spread location, furthest from the rear of the reflector, i.e. to the left as shown, as it would be set together with socket-mount bracket 24 in FIG. 3.

FIG. 7 shows lamp support bracket 28 having been set to the medium beam spread preset location in mid-range, as it would be set together with socket-mount bracket 24 as in FIG. 4.

Similarly, FIG. 8 shows lamp support bracket 28 having been set to the narrow beam spread preset location, thus matching the preset location of socket-mount bracket 24 as in FIG. 5. The two slots (34, FIGS. 3, 4 and 6) are seen in FIGS. 5 and 8 to extend somewhat further beyond this (narrow beam) end of the working travel range of lamp socket 14 and the spring-loaded fasteners 32 (FIGS. 3 and 6): the openings thus provided provide clearance for a pair of wires from the lamp socket 14, that may be conducted through a corresponding pair of holes configured in socket mount bracket 24, seen in FIGS. 3–8 located within the two slots 34 next to fasteners 32.

For economy, lamp support base brackets 26A and 26B can both be stamped as a common sheet metal part in flat form, then formed as required to configure the oppositely oriented mounting flanges of brackets 26A and 26B.

Figure 9:
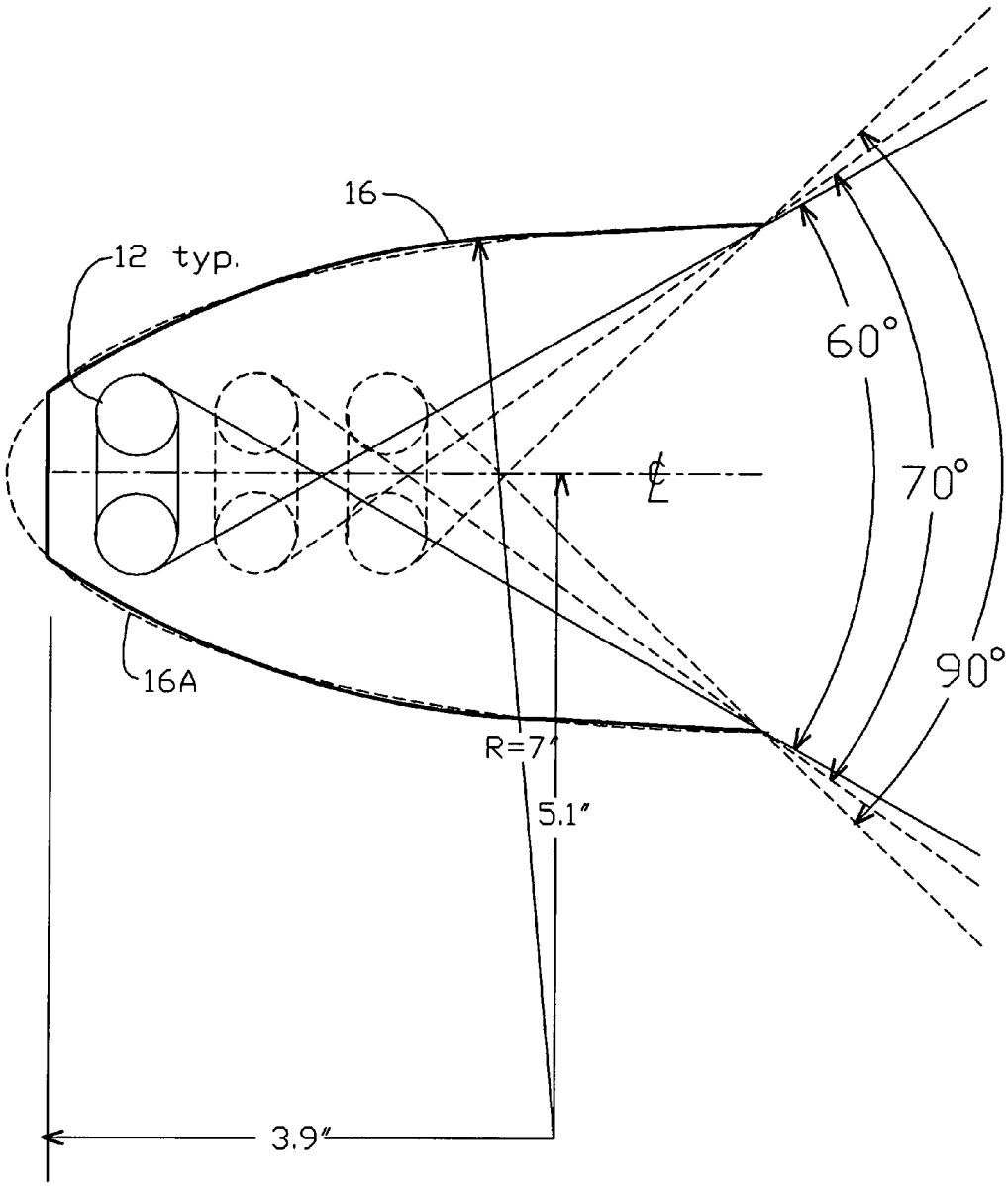
FIG. 9 is a cross-section taken through axis 9—9 of FIG. 1 showing the three preset lamp locations and light beam paths for boundaries of the wide, medium and narrow beam spreads corresponding to the three preset lamp support locations shown in FIGS. 3&6, 4&7 and 5&8 respectively.

FIG. 9 is a cross-section taken through axis 9—9 of FIG. 1 showing the lamp positions and the corresponding light beam paths for the three preset lamp support locations corresponding to FIGS. 3&8, 4&7 and 5&6 for beam spread angles of approximately 60, 70 and 90 degrees respectively, as designated for this embodiment. These angles are determined principally by light masking at the light-exit aperture of the reflector 16. The general shape of the reflector 16 indicated by the solid dark line, with suggested dimensions shown, approximates a parabola or a half-ellipse, indicated by the broken line. This reflector cross-sectional shape provides uniformity throughout the selected field of illumination.

As matters of design choice, the range of beam width may be extended and/or the number of preset locations may be increased (or decreased to two) and/or the increments varied.

The invention can be practiced with alternative types of lamps, e.g. incandescent or halogen, with alternative styles of lamps, e.g. double-ended straight tubes in dual or quadruples, and or with more or less than two stacked identical units as described above, contained in a single housing.

Practice of the present invention is not limited to indoor locations as described above: outdoor and/or "wet" locations can also be accommodated by selection of materials and by other weather-proofing measures of known art such as a transparent lens panel.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A lighting unit that provides adjustable beam spread, including at least one lighting cell comprising:

an elongated electric U-shaped tubular fluorescent lamp, known as biax, having a curved end and a double contact end;

an elongated reflector having a generally parabolic cross-sectional shape, symmetrically disposed about a central plane of symmetry that extends from a closed rear region of the reflector to a generally rectangular frontal light-exit aperture;

a first mounting assembly, made and arranged to support the double contact end of the lamp relative to the reflector, having a first base bracket mounted fixedly relative to the reflector near a first end thereof and extending within the reflector, a socket-mount bracket adjustably attached to the first base bracket, and socket means for electrically connecting to the double contact end;

a second mounting assembly, made and arranged to support the curved end of the lamp relative to the reflector, having a second base bracket mounted fixedly relative to the reflector near a second end thereof and extending within the reflector, a lamp-holder bracket, adjustably attached to the second base bracket, made and arranged to support the curved end of the lamp; the first and second mounting assemblies each being provided with a user handle made and arranged to enable a user to conveniently deploy any one of the three preset light source positions and thus cause the lighting unit to produce a corresponding one of the three predetermined angles of beam spread;

said first and second mounting assemblies being made and arranged to support the lamp located in the central plane, substantially parallel to the rear of the reflector and in a manner to enable a user, with requiring tools, to move the light source to a selected one of three preset light source locations with different separation from the rear region of the reflector corresponding to three designated angles of beam spread.

2. The lighting unit as defined in claim 1 further comprising:

the first base bracket being configured with a pair of slotted openings in a predetermined pattern;

a pair of spring-loaded fasteners made and arranged to urge the socket-mount bracket against the first base bracket and to allow a travel range there between enabled by the pattern of the slotted openings;

a spring-loaded set pin attached to the socket-mount bracket, made and arranged to interact in a detented manner with three spaced openings configured in the first base bracket to implement the three preset light source locations;

the second base bracket being configured with a pair of slotted openings in the predetermined pattern as in the first base;

a second pair of spring-loaded fasteners made and arranged to urge the lamp-holder bracket against the first base bracket and to allow a travel range there between constrained by the pattern of the slotted openings; and a second spring-loaded set pin attached to the socket-mount bracket, made and arranged to interact with a selected one from a row of three spaced round openings configured in the second base bracket in a detented manner to implement the three preset light source positions.

3. The lighting unit as defined in claim 1, implemented as a dual unit, further comprising:

a second similar lighting cell;

a metal housing made and arranged to contain the two lighting cells stacked one above the other;

a metal mounting yoke in a generally U shape with two arms extending against opposite ends of the metal housing, attached thereto in a swivel manner; and clamping means for securing the mounting yoke to the housing for deployment of the lighting unit.

* * * * *